US007568265B2

(12) United States Patent
Kohama

(10) Patent No.: US 7,568,265 B2
(45) Date of Patent: Aug. 4, 2009

(54) BUCKLE APPARATUS AND SEAT BELT APPARATUS

(75) Inventor: Shigeru Kohama, Tokyo (JP)

(73) Assignee: Takata Corporation, Tokyo (JP)

( * ) Notice: Subject to any disclaimer, the term of this patent is extended or adjusted under 35 U.S.C. 154(b) by 420 days.

(21) Appl. No.: 11/420,311

(22) Filed: May 25, 2006

(65) Prior Publication Data

US 2006/0272138 A1 Dec. 7, 2006

(30) Foreign Application Priority Data

Jun. 6, 2005 (JP) ..... 2005-166036

(51) Int. Cl.
*A44B 11/25* (2006.01)
*A44B 11/26* (2006.01)

(52) U.S. Cl. ..... 24/633

(58) Field of Classification Search ..... 24/629, 24/633, 635, 636, 641; 180/268; 280/801.1, 280/805; 362/483, 487, 488, 511, 559
See application file for complete search history.

(56) References Cited

U.S. PATENT DOCUMENTS 4,181,832 A * 1/1980 Ueda ..... 200/61.58 B
4,237,586 A * 12/1980 Morinaga ..... 24/641
4,928,366 A * 5/1990 Ballet ..... 24/641
4,933,818 A * 6/1990 Eckmann ..... 362/511
5,176,439 A * 1/1993 Kawamura ..... 362/108
5,181,773 A * 1/1993 Colvin ..... 362/488
5,438,492 A * 8/1995 Collins et al. ..... 362/108
5,678,913 A 10/1997 Ishimaru et al.
5,839,809 A 11/1998 Ishimaru et al.
5,892,436 A * 4/1999 Blackburn et al. ..... 340/457.1
5,944,135 A * 8/1999 Blackburn et al. ..... 180/268
6,120,158 A 9/2000 Ishimaru et al.
6,558,027 B2 * 5/2003 Ellis et al. ..... 362/483
7,347,579 B2 * 3/2008 Kohama et al. ..... 362/108
7,360,794 B2 * 4/2008 Kohama ..... 280/801.1

FOREIGN PATENT DOCUMENTS

CH 694 354 A5 12/2004

(Continued)

OTHER PUBLICATIONS

A search report dated Aug. 3, 2006 from the European Patent Office in corresponding European Application No. 06010617.6-2314.

*Primary Examiner*—Robert J Sandy
*Assistant Examiner*—Ruth C Rodriguez
(74) *Attorney, Agent, or Firm*—Fitch, Even, Tabin & Flannery

(57) ABSTRACT

A buckle apparatus and a seat belt apparatus are provided capable of suppressing an occurrence of an unevenness of brightness at a time of leading illuminating light flux in an inner part of the reflector. In one form, a reflector having a curved face portion that leads illuminating light flux, which is eradiated from a light source to a light receiving face facing a light source, to an entire face of a light emitting face is provided. Further, a light intensity control device is configured to be connected in series to the light sources, and an optimum light intensity control device is selected while exchanging various light intensity control devices corresponding to the required capability and the specifications.

12 Claims, 10 Drawing Sheets

FOREIGN PATENT DOCUMENTS

| | | | |
|---|---|---|---|
| DE | 26 19 343 | A1 | 11/1977 |
| DE | 26 39 149 | A1 | 3/1978 |
| JP | 61-40910 | | 3/1986 |
| JP | 5-15813 | | 3/1993 |
| JP | 6-11237 | | 2/1994 |
| JP | 6-82627 | | 11/1994 |
| JP | 11-133425 | | 5/1999 |
| JP | 2002-107186 | | 4/2002 |
| JP | 2004-247207 | | 9/2004 |
| WO | WO 02/05675 | A1 | 1/2002 |

* cited by examiner

NON-LATCHED STATE

FIG. 9(b) LATCHED STATE PRIOR ART

BUCKLE APPARATUS AND SEAT BELT APPARATUS

FIELD OF THE INVENTION

The present invention relates to a buckle apparatus, and more particularly to a buckle apparatus provided with an illuminating function, and to a seat belt apparatus having the buckle apparatus.

BACKGROUND OF THE INVENTION

Hitherto, in a seat belt apparatus for use in a motor vehicle, or the like, a buckle apparatus for fixing an end portion of webbing (belt) that keeps an occupant under restraint, or the buckle apparatus for fixing a tongue being provided at a turned back end portion of the webbing to a motor vehicle is provided.

FIGS. 9(*a*), 9(*b*), and 10 illustrate an example of such a buckle apparatus in a conventional technology, in which FIG. 9(*a*) is a longitudinal cross-section illustrating a buckle apparatus where a tongue is in a non-latched (disengaged) state with the buckle apparatus, FIG. 9(*b*) is a longitudinal cross-section illustrating the buckle apparatus where the tongue is in a latched (engaged) state with the buckle apparatus, and FIG. 10 is an exploded perspective view illustrating an entire structure of the buckle apparatus. In addition, part of constituting elements shown in FIG. 10 is omitted in FIGS. 9(*a*) and 9(*b*) to avoid complication of the drawings.

(1) Entire Construction of the Buckle Apparatus

In FIGS. 9(*a*), 9(*b*), and 10, a buckle apparatus 1 has the following elements, i.e., a base 2 formed of a U-shaped frame having two of a left and a right side walls, 2*a* and 2*b*, and a bottom portion 2*c*, a latch member 4 being rotatably supported by means of both of the side walls, 2*a* and 2*b*, of the base 2, and capable of being latched (engaged) with a tongue 3 that serves as a member for a belt, which is to be latched, a slider (locking member) 5 that is movably supported by means of the latch member 4 for relative movement on an upper face of the latch member 4, and that prevents the latch member 4 from moving in a releasing direction for a latched state of the latch member 4 when the tongue 3 and the latch member 4 are latched with each other, a slider spring 6 that always causes the slider 5 to be biased toward the latch member 4 by means of being compressed between the slider 5 and the latch member 4, a locking pin 7 being rotatably supported by means of holes, 2*d* and 2*e*, of both of the side walls, 2*a* and 2*b*, of the base 2, which presses (locks) an upper face of the slider 5 that prevents the latch member 4 from moving in the releasing direction for the latched state of the latch member 4 when the tongue 3 and the latch member 4 are latched with each other, a release button (operation member) 8 movably provided in a longitudinal direction at both of the side walls, 2*a* and 2*b*, of the base 2, an inertia lever 9 positioned between a release button 8 and the latch member 4 and being rotatably supported by means of grooves, 2*f* and 2*g*, of both of the side walls, 2*a* and 2*b*, an ejector 10 being slidably provided in a longitudinal direction of the base 2 at a bottom portion 2*c* of the base 2 and separating the tongue 3 from the buckle apparatus 1, an ejector spring 11 that always keeps the ejector 10 being biased in a direction for the tongue 3 to be separated from the buckle apparatus 1, and covers (an upper cover UC and a lower cover LC) that include these elements described above in a manner so as to cover from above and below.

The latch member 4 is provided with rotating shafts, 4*a* and 4*b*, and the rotating shafts, 4*a* and 4*b*, are rotatably supported by means of supporting grooves, 2*h* and 2*i*, formed in both of the side walls, 2*a* and 2*b*, of the base 2. In this case, the latch member 4 is biased in a clockwise direction in the drawings by means of the slider spring 6, in the disengaged (non-latched) state shown in FIG. 9(*a*), and the latch member 4 is biased also in the clockwise direction in the drawings by means of the ejector spring 11 in the latched state, shown in FIG. 9(*b*). As a result, the latch member 4 is always biased by means of either one of two springs, 6 and 11. Further, the latch member 4 is provided with a pair of arms, 4*d* and 4*e*, which is extended from the rotation shafts, 4*a* and 4*b*, each of tip end portions of which serves as portions, 4*d*1 and 4*e*1, to be pressed. Both of these portions, 4*d*1 and 4*e*1, to be pressed are respectively constructed to be capable of being pressed rightward in FIG. 9(*a*) by means of pressing portions, 10*a* and 10*b*, (shown in FIG. 10), of the ejector 10 at a right end thereof, as described later.

The slider 5 is provided with a protruding shaft 5*a* at a center thereof extending in a longitudinal direction of the buckle apparatus 1 and the protruding shaft 5*a* is penetrating through a hole 4*c* of the latch member 4. In addition, the protruding shaft 5*a* is fit into the slider spring 6 and the slider spring 6 is compressed by being sandwiched between the latch member 4 and the slider 5. Further, the slider 5 is provided with a pair of left and right engaging shafts, 5*b* and 5*c*.

The pair of engaging shafts, 5*b* and 5*c*, are respectively engaged and supported by means of engaging grooves, 2*j* and 2*k*, respectively formed at both of the side walls, 2*a* and 2*b*, of the base 2, and are protruding outward in a predetermined amount from both of the side walls, 2*a* and 2*b*. In this case, both of the engaging grooves, 2*j* and 2*k*, respectively having first groove portions, 2*j*1 and 2*k*1, both of which are extending in a longitudinal direction (namely, the moving direction of the release button 8) of the buckle 1, and second groove portions, 2*j*2 and 2*k*2, extending upward in a sloping manner from these first groove portions, 2*j*1 and 2*k*1, in an opening manner. Further, the hooking shafts, 5*b* and 5*c* of the slider 5 are respectively configured to be movable along the first groove portions, 2*j*1 and 2*k*1, in usual operation, and are configured to be movable along the first groove portions, 2*j*1 and 2*k*1, and the second groove portions, 2*j*2 and 2*k*2, in an unusual operation, i.e., when the latched state is forcibly released.

On the other hand, the side walls, 2*a* and 2*b*, of the buckle apparatus 1 including each of the grooves and the holes have line symmetry at a center line in a longitudinal direction of the buckle apparatus 1.

The release button 8 is provided with a left and a right side walls, 8*a* and 8*b*, extending in a longitudinal direction of the buckle apparatus 1, and a left and a right protruding portions, 8*c* and 8*c* (although only one protruding portion is shown and the other protruding portion is not shown, both of the protruding portions are denoted by 8*c*, as a matter of convenience for later explanation), extending in a longitudinal direction of the buckle apparatus 1 are respectively provided between the side walls, 8*a* and 8*b*, as shown in FIG. 10. A pressing portion 8*f* that is having a vertical face (in a similar manner, both of the pressing portions are hereinafter referred to as 8*f*), which presses each of the engaging shafts, 5*b* and 5*c*, of the slider 5 so as to move the same in a releasing direction when the releasing button 8 is moved in a releasing direction, is formed in each of the internal faces of both of the side walls, 8*a* and 8*b*.

On the other hand, similar to the side walls, 2*a* and 2*b*, of the buckle apparatus 1, both of the side walls, 8*a* and 8*b*, of the release button 8 have line symmetry at the center line in a longitudinal direction of the buckle apparatus 1.

The inertia lever 9 is provided with a pair of left and right rotation shafts, 9*a* and 9*b*, and these rotation shafts, 9*a* and 9*b*, are rotatably fit into the grooves, 2*f* and 2*g*, of both of the side walls, 2*a* and 2*b*, of the base 2. Further, the inertia lever 9 is provided with an engaging connecting portion 9*c* at a lever side formed of a round pin-like shape having a round cross-section.

(2) Basic Motion of the Buckle Apparatus

Next, a latching motion of the buckle apparatus 1 with the tongue 3 in the thus constructed present embodiment will be explained.

In the non-latched state of the buckle apparatus 1 where the tongue 3 is not inserted thereto, a position of the ejector 10 is set to the position of a leftmost limit by means of spring force of the ejector spring 11, as shown in FIG. 9(*a*). In the leftmost limit position of the ejector 10, the latch member 4 is rotated in an upper direction (in a clockwise direction from the latched state) in relationship among the slider 5, the locking pin 7, and the slider spring 6. At this moment, the slider 5 is disengaged from the locking pin 7 and is positioned to be upwardly rotated. As a result, an upper face of the latch member 4 is kept in contact with a lower face of the locking pin 7. In this state, a joggle portion 4*f* of the latch member 4 is moved away from the inserting path of the tongue 3 and the latch member 4 is set to be at a non-latching position where the joggle portion 4*f* is not latched with the tongue 3.

When the tongue 3 is inserted through an opening (tongue insertion inlet) 1*a* that is provided at one side end portion (left end portion in the middle in FIGS. 9(*a*) and 9(*b*)) of the upper cover UC of the buckle apparatus 1, in the non-latched state of the buckle apparatus 1, shown in FIG. 9(*a*), a right end of the tongue 3 is caused to be in contact with a left end of the ejector 10 and the ejector 10 is pressed rightward. Then, because the ejector 10 moves rightward compressing the ejector spring 11 corresponding to an inserting amount of the tongue 3, a pressing portions 10*a* and 10*b* of the ejector 10 presses the portions, 4*d*1 and 4*e*1, of the latch member 4 to be pressed, in a rightward direction and thereby the latch member 4 is downwardly (in a counterclockwise direction) rotated. Consequently, the joggle portion 4*f* of the latch member 4 proceeds to a moving path of the tongue 3 and is fit into a latching hole 3*a* of the tongue 3. Accordingly, the latch member 4 is in a latching position. Further, when inserting force of the tongue 3 is released, the ejector 10 presses the right end of the tongue 3 by means of spring force of the ejector spring 11; a right end portion of the latching hole 3*a* of the tongue 3 is engaged with the joggle portion 4*f*; the tongue 3 is latched with the buckle apparatus 1; and the tongue 3 and the buckle apparatus 1 are caused to be in a latched state, shown in FIG. 9(*b*).

At this moment, the slider 5 proceeds to a position below the locking pin 7 by means of the spring force of the slider spring 6, and an upper face of the slider 5 is pressed by the locking pin 7. Accordingly, the latch member 4 cannot be pulled out from the latching hole 3*a* of the tongue 3 and the latched state of the tongue 3 and the buckle apparatus 1 are firmly maintained. This is because the slider 5 holds the latch member 4 at a latching position, shown in FIG. 9(*b*).

When the release button 8 is pressed rightward so as to release the latched state of the tongue 3 and the buckle apparatus 1, shown in FIG. 9(*b*), the release button 8 is moved rightward. Further, a pressing portion 8*f* of the release button 8 presses each of the engaging shafts, 5*b* and 5*c*, of the slider 5 rightward, and the slider 5 is moved rightward, i.e., in a direction toward the latch member 4, against the biasing force of the slider spring 6. Then, the engaging shafts, 5*b* and 5*c*, of the slider 5 are displaced from the first groove portions, 2*j*1 and 2*k*1, and a left end upper face of the slider 5 is displaced from a lower face of the locking pin 7. As a result, the slider 5 is caused not to be pressed by means of the locking pin 7.

Then, the slider 5 and the latch member 4 are rotated in a clockwise direction and the joggle portion 4*f* is moved upward. The ejector 10 strikes up the latch member 4 via the tongue 3; the latch member 4 and the slider 5 are further rotated in a clockwise direction around the rotation shafts, 4*a* and 4*b*, as a rotation center; the joggle portion 4*f* is displaced away from the latching hole 3*a* of the tongue 3; and at the same time, the tongue 3 is pushed out in a left direction. This is because the ejector 10 is kept under tension in a direction for releasing the latched state by the spring force of the ejector spring 11.

As shown in FIG. 9(*a*), when an upper face of a joggle portion 4*f* side of the latch member 4 is caused to be in contact with the locking pin 7, the rotation of the latch member 4 and the slider 5 in a clockwise direction is stopped. At this moment, a left end of the slider 5 is caused to be in contact with the locking pin 7 by means of the tension force of the slider spring 6. Finally, the ejector 10 is located at a leftmost limit position, and the latch member 4 is located at a non-latching position. Consequently, the buckle apparatus 1 is in the non-latched state where the tongue 3 is displaced.

In addition, for switching the aforementioned positions of the buckle apparatus 1 and the tongue 3, from the latched position to the non-latched position, and vice versa, a magnet 50 (a permanent magnet) for detecting the latched state is provided in the slider 5, as shown in FIG. 10. Correspondingly, a magnet sensor 100 for generating electromotive force by means of a magnetic field of the aforementioned magnet 50 is provided in a sensor holder 60 whose claw portions, 60*a* and 60*b*, are latched with a engaging holes, 2*p* and 2*q*, of both of the side walls, 2*a* and 2*b*, of the base 2. The magnet sensor 100 detects whether the slider 5 is contiguous to (corresponding to the non-latched state) or distant from (corresponding to the latched state) the magnet sensor 100 on the basis of that the magnet field is small or large, and outputs corresponding current value, for example.

On the other hand, in such a buckle apparatus 1, particularly, at a nighttime or the like, when an inside of a room of the motor vehicle is in a state of a darkroom, a buckle apparatus provided with an illuminating function to ease recognition for a position of the buckle apparatus 1, or to ease recognition for an inserting opening of the buckle apparatus 1 for inserting the tongue 3, is known (for example, refer to the Patent Document No. JP 1993-15813).

FIG. 8 is a perspective view illustrating an illumination apparatus that is built in the buckle apparatus of the aforementioned conventional technology.

In an illumination apparatus, shown in FIG. 8, a printed circuit board 20 is disposed at the aforementioned lower cover LC. A plurality of conductive wiring portions 21 are formed in the printed circuit board 20. Further, a harness 22 connected to a controller (not shown), an LED 23 for illuminating the vicinity of an insertion inlet for the tongue 3, and a resistor 24 for setting electric current supplied to the LED to a predetermined value are connected to the wiring portion 21, by means of soldering.

The LED 23 is disposed in the vicinity of the insertion inlet for the tongue 3, and for example, a portion around the insertion inlet for the tongue 3 is illuminated by emitting light when the controller detects that an occupant is seated in a seat.

At this moment, a technology is also known in which an emitting face of illuminating light flux is controlled by providing a reflector (light guide) for illuminating light flux eradiated from the LED 23 in front of the LED 23 (for example, refer to Patent Document JP No. 1993-15813).

On the other hand, in the thus constructed buckle apparatus 1, even though illuminating flux eradiated from an LED 23 is controlled by means of a reflector, the illuminating flux is led as a parallel light flux in the reflector because a light receiving face facing the LED 23 is formed to be a perpendicular face. However, usually, a light emitting face serving as a light eradiating face has a variant form serving as a guide for a tongue 3, and is not formed of a face in parallel with the light receiving face. Accordingly, when the parallel light flux reaches the light emitting face from an inside the reflector, an unevenness of light intensity (brightness) occurs due to uneven strength of the light.

Accordingly, an object of the present invention is to provide a buckle apparatus and a seat belt apparatus capable of suppressing occurrence of the unevenness of brightness at a light emitting face of the reflector.

SUMMARY OF THE INVENTION

To achieve the above-described object, a buckle apparatus in a first form is characterized in including a cover having an insertion inlet at one side, a buckle portion provided in the cover and engaged with a tongue of a seat belt inserted through the insertion inlet, a light source provided in the vicinity of the insertion inlet, and a reflector including a light receiving face facing the light source, and a light emitting face, in which the light receiving face of the reflector includes curved face portion being configured to lead illuminating flux eradiated from the light source to a substantially whole area of the light emitting face.

The buckle apparatus in a second form is the buckle apparatus of the first form including a light intensity control device for controlling an emitting amount of the light source.

The seat belt apparatus in a third form is characterized in including, webbing for keeping an occupant under restraint, a retractor apparatus capable of retracting the webbing, a buckle apparatus connected to a member at a fixing side, and a tongue provided in the webbing, in which the buckle apparatus includes, a cover having an insertion inlet at one side, a buckle portion provided in the cover and engaged with the tongue being inserted through the insertion inlet, a light source provided in the vicinity of the insertion inlet, and a reflector including a light receiving face facing the light source and a light emitting face, and in which the light receiving face of the reflector includes curved face portion being configured to lead illuminating flux eradiated from the light source to a substantially whole area of the light emitting face.

A buckle apparatus of the first form and a seat belt apparatus of the third form are provided with a reflector having a curved face portion that leads illuminating flux, which is eradiated from a light source to a light receiving face facing the light source, to a substantially whole area of the light emitting face, and accordingly, an occurrence of an unevenness of brightness at a time of leading the illuminating flux in an inner part of the reflector can be suppressed.

In the buckle apparatus of the second form, an emitting amount of the light source is controlled by means of a light intensity control device, and accordingly, the illuminating light intensity can be set corresponding to a size of the buckle, an opening area of an insertion inlet, or the like.

BRIEF DESCRIPTION OF THE DRAWINGS

FIG. 2(*b*) is a circuit diagram illustrating a control circuit of light intensity with respect to the present invention;

FIG. 3(*b*) is a side elevation showing a relationship between the reflector and a slimline LED light source of the buckle apparatus with respect to the present invention;

FIG. 5(*b*) is a side elevation illustrating a relationship between the reflector and the LED light source of the buckle apparatus with respect to the present invention;

FIG. 6(*b*) is a side elevation illustrating a relationship between the reflector and a transversely mounted LED light source of the buckle apparatus with respect to the present invention;

FIG. 9(*b*) is a longitudinal cross-section illustrating a conventional buckle apparatus in a latched (engaged) state with the tongue.

DETAILED DESCRIPTION OF THE PREFERRED EMBODIMENTS

A buckle apparatus and a seat belt apparatus of the present invention will be explained referring to FIGS. 1 through 7.

Figure 1:
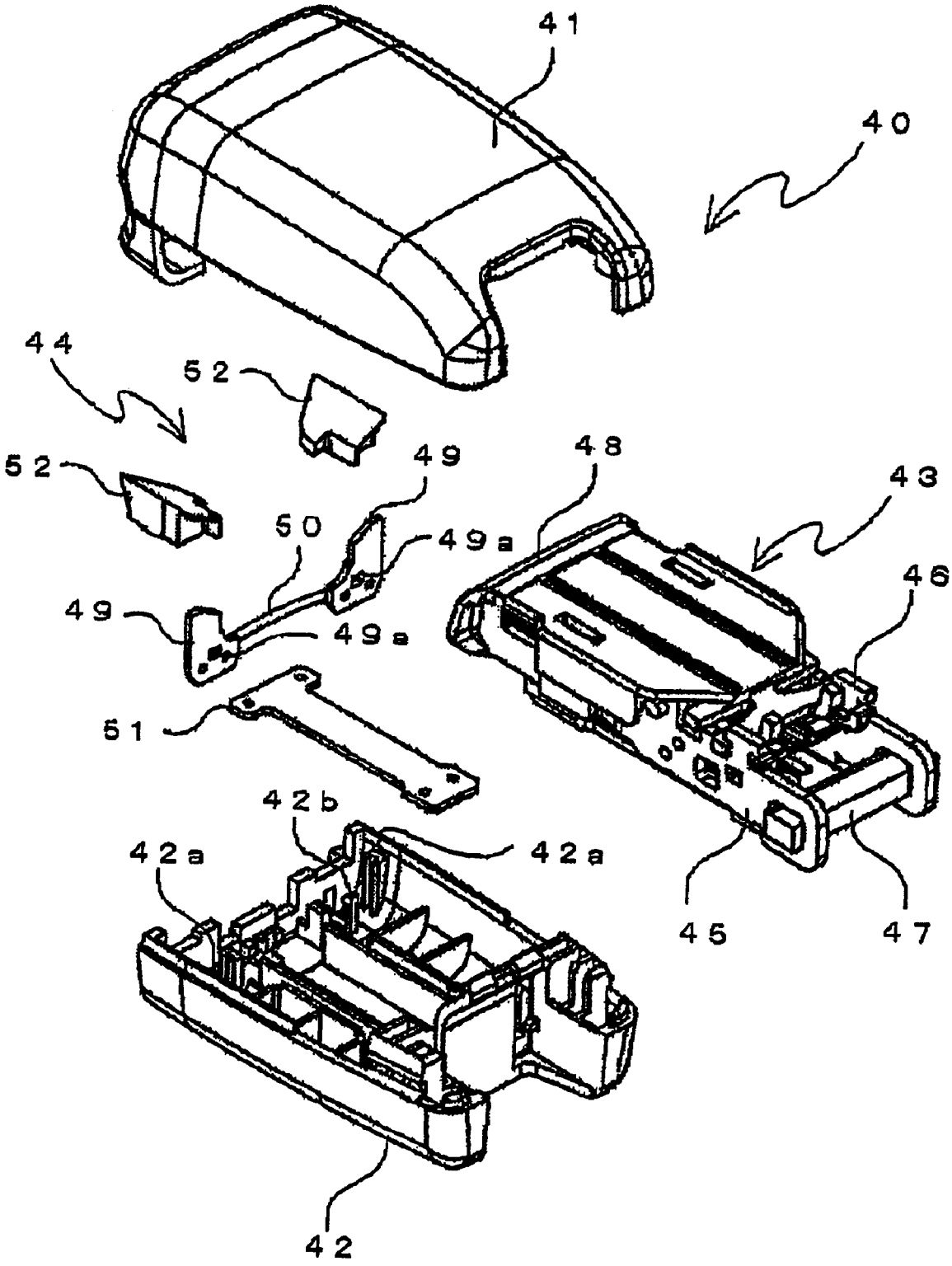
FIG. 1 is an exploded perspective view illustrating a buckle apparatus with respect to the present invention.
Figure 2A:
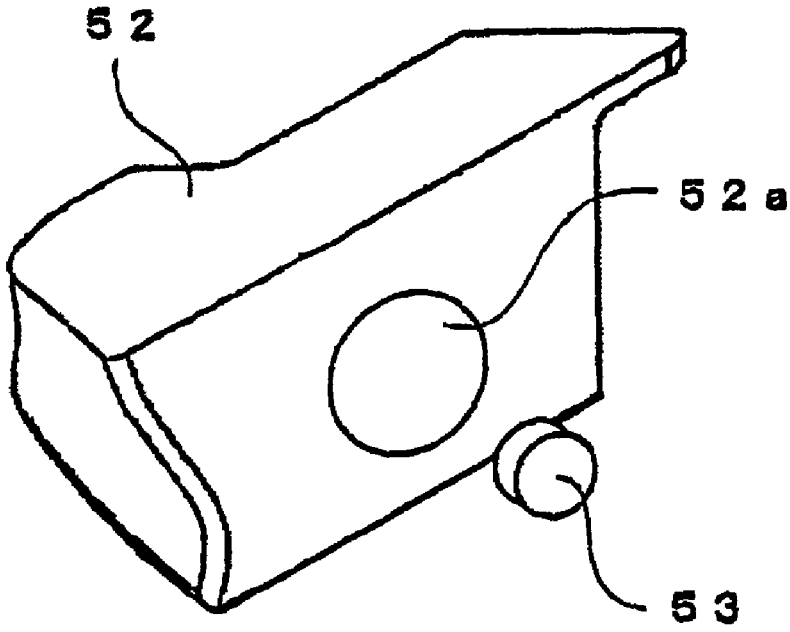
FIG. 2(*a*) is a perspective view illustrating a reflector with respect to the present invention.
Figure 2B:
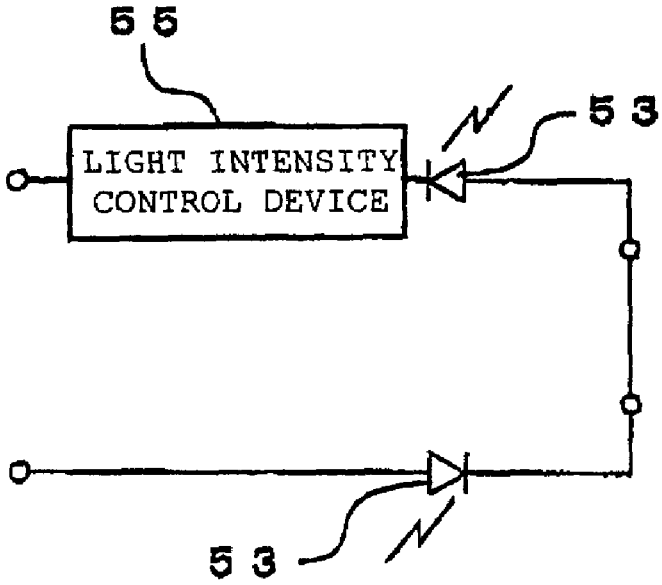
Figure 3A:
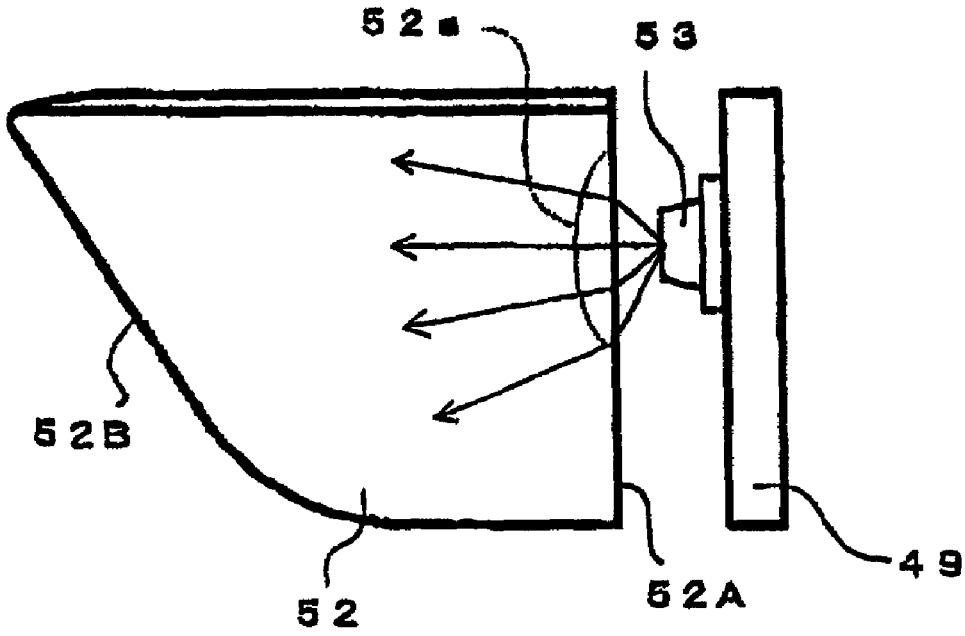
FIG. 3(*a*) is a plan view showing a relationship between the reflector and a slimline LED light source of the buckle apparatus with respect to the present invention.
Figure 3B:
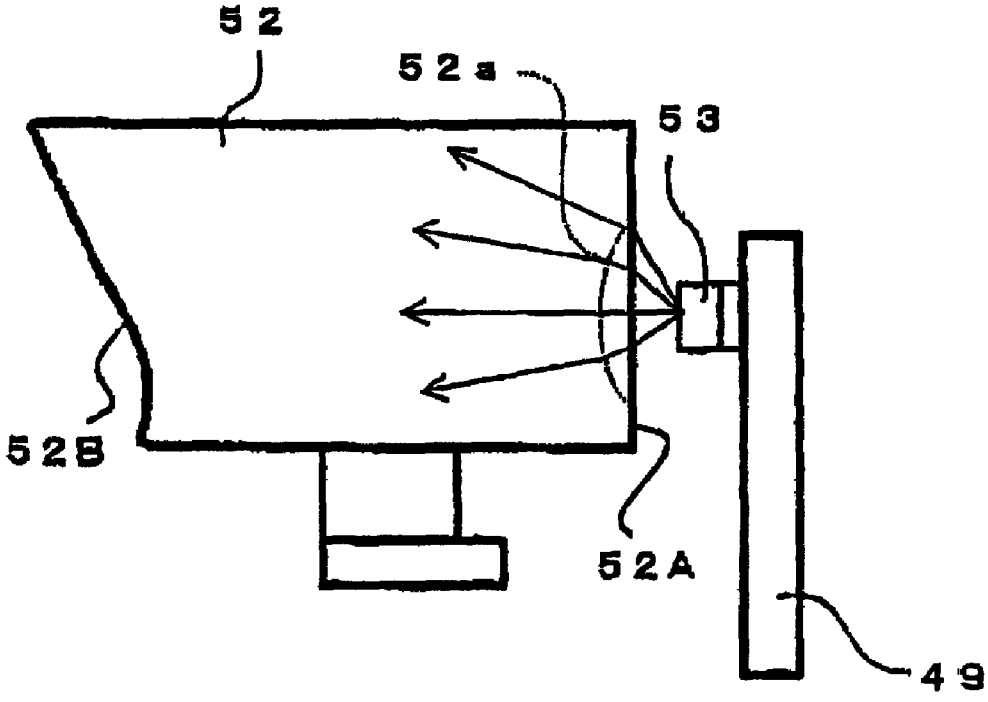
Figure 4A:
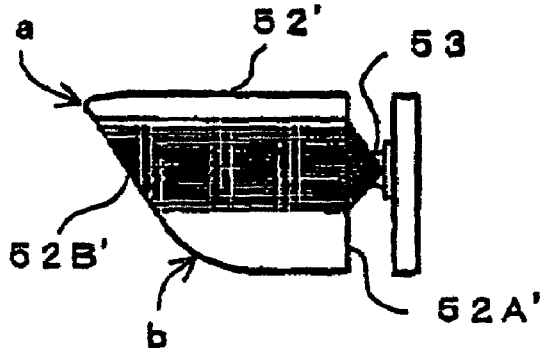
FIGS. 4(*a*) through 4(*d*) are explanatory illustrations explaining an effect of the present invention.
Figure 4B:
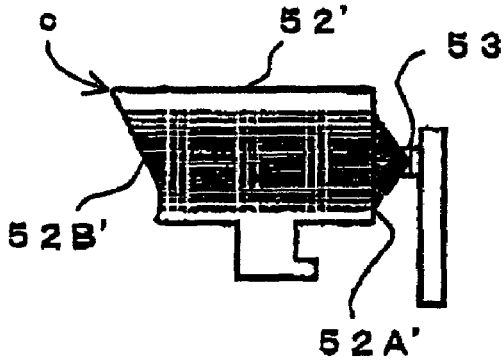
Figure 4C:
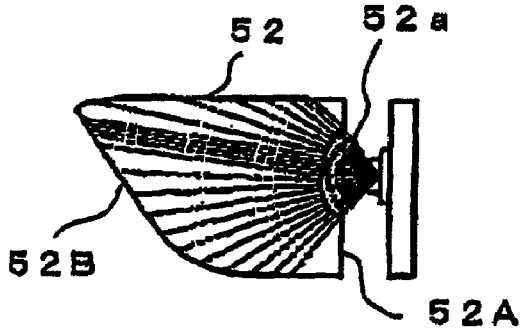
Figure 4D:
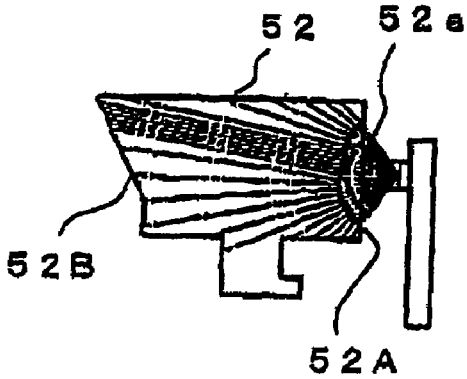
Figure 5A:
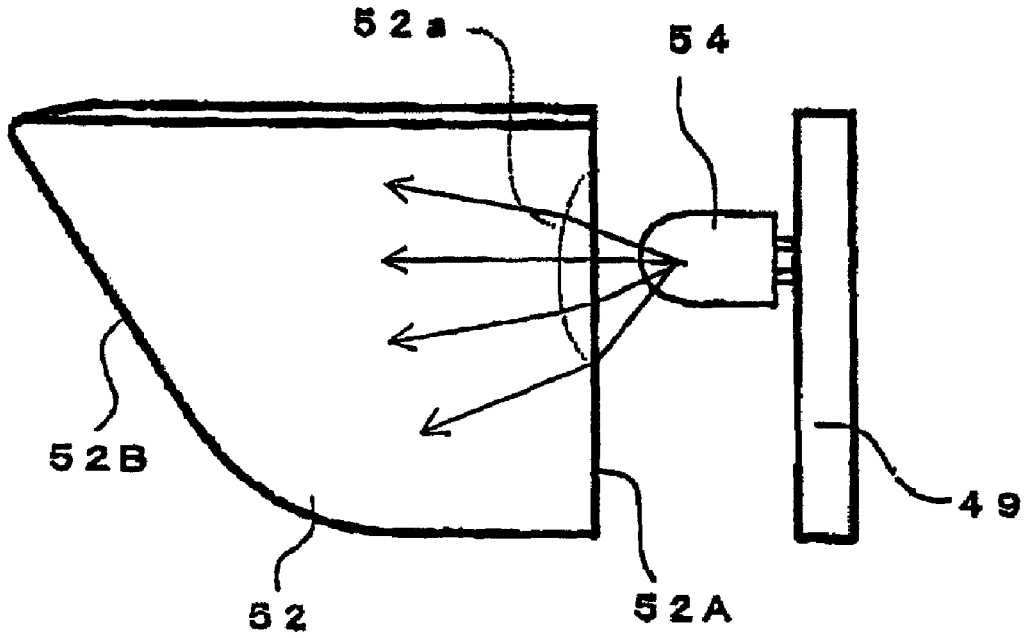
FIG. 5(*a*) is a plan view illustrating a relationship between the reflector and the LED light source of the buckle apparatus with respect to the present invention.
Figure 5B:
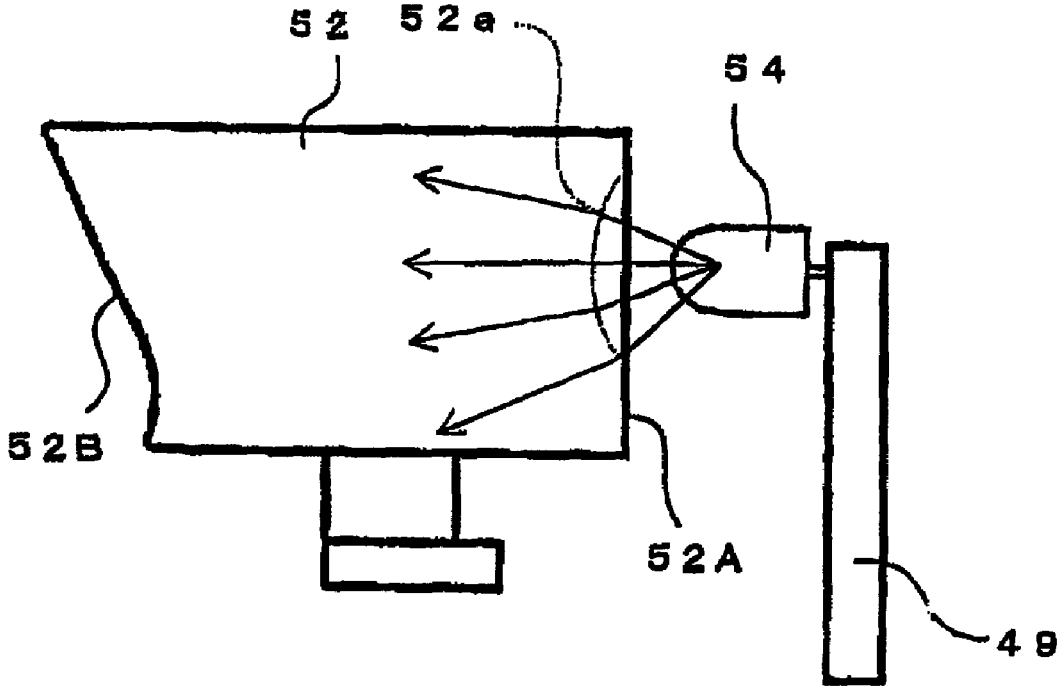
Figure 6A:
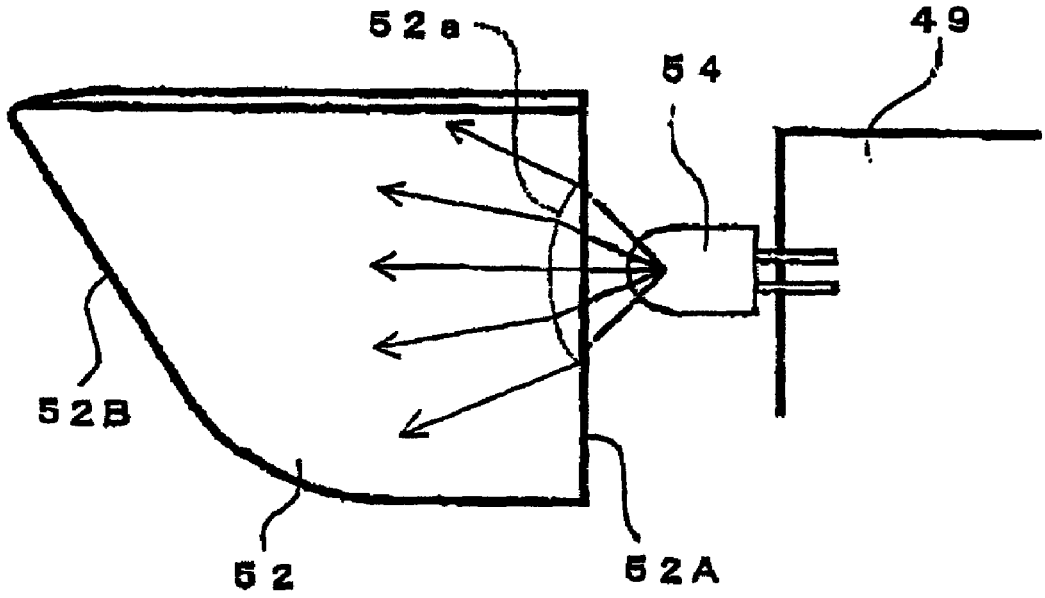
FIG. 6(*a*) is a plan view illustrating a relationship between the reflector and a transversely mounted LED light source of the buckle apparatus with respect to the present invention.
Figure 6B:
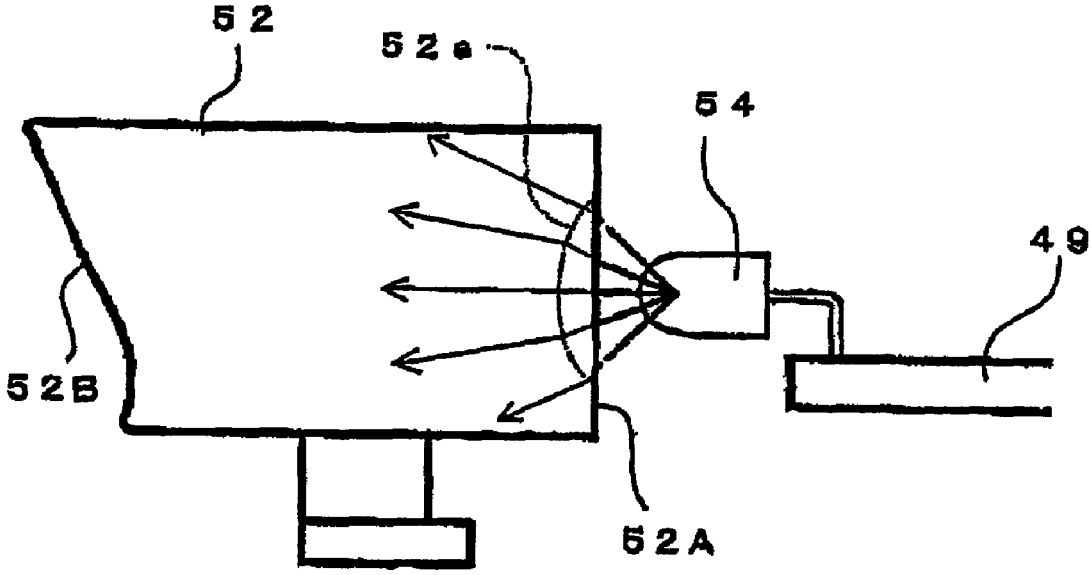

FIG. 1 is an exploded perspective view illustrating a buckle apparatus with respect to the present invention; FIG. 2(*a*) is a perspective view illustrating a reflector with respect to the present invention, and FIG. 2(*b*) is a circuit diagram illustrating a control circuit for light intensity with respect to the present invention; FIG. 3(*a*) is a plan view showing a relationship between the reflector and a slimline LED light source of the buckle apparatus with respect to the present invention; FIG. 3(*b*) is a side elevation showing a relationship between the reflector and a slimline LED light source of the buckle apparatus with respect to the present invention; FIGS. 4(*a*) through 4(*d*) are explanatory illustrations explaining an effect of the present invention; FIG. 5(*a*) is a plan view illustrating a relationship between the reflector and the LED light source of the buckle apparatus with respect to the present invention, and FIG. 5(*b*) is a side elevation illustrating a relationship between the reflector and the LED light source of the buckle apparatus with respect to the present invention; FIG. 6(*a*) is a plan view illustrating a relationship between the reflector and a transversely mounted LED light source of the buckle apparatus with respect to the present invention; FIG. 6(*b*) is a side elevation illustrating a relationship between the reflector and a transversely mounted LED light source of the buckle apparatus with respect to the present invention; and FIG. 7 is a perspective view illustrating a seat belt apparatus for use in a driver's seat of a motor vehicle in a using state, showing an example of the seat belt apparatus.

Figure 7:
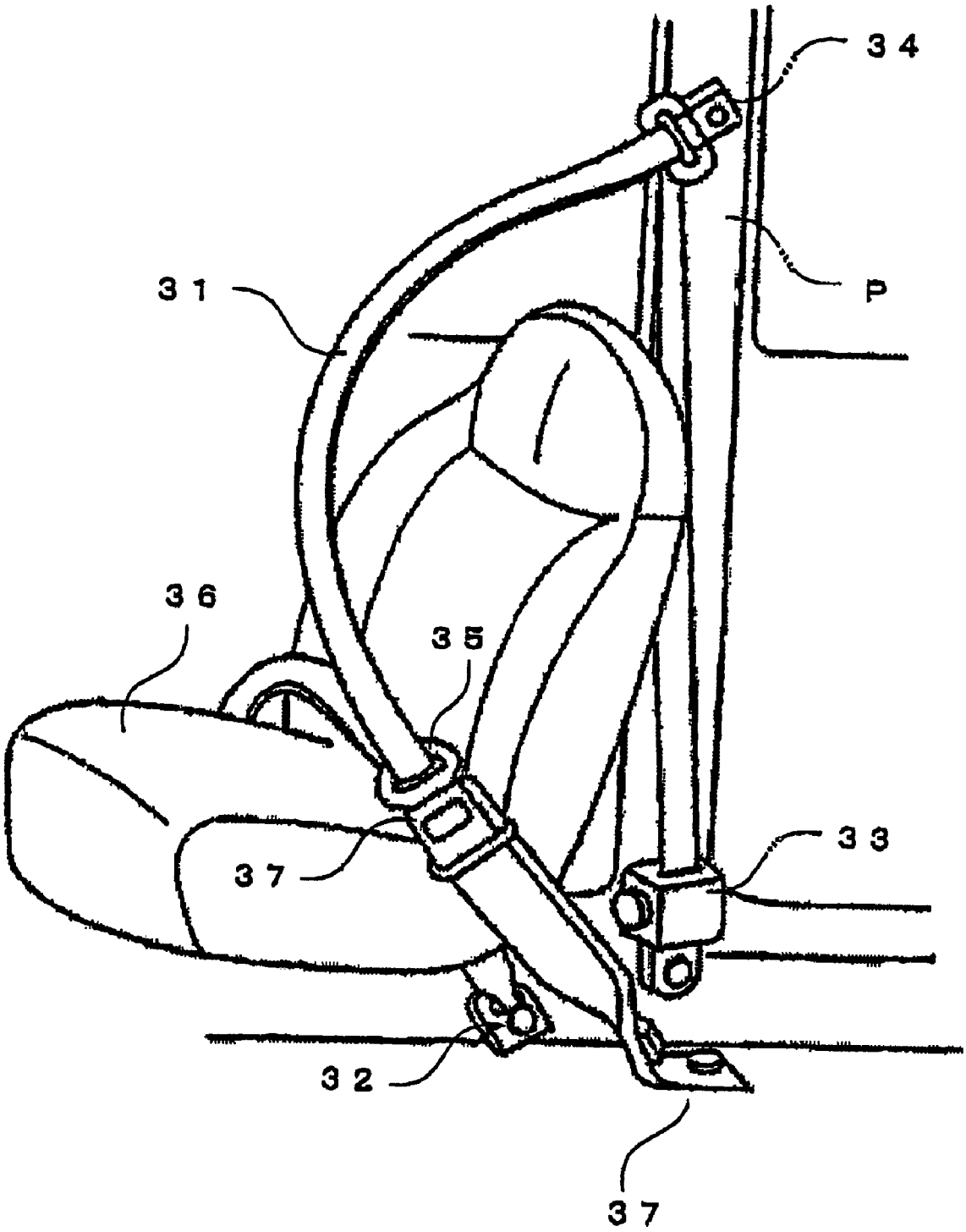
FIG. 7 is a perspective view illustrating a seat belt apparatus for use in a driver's seat of a motor vehicle in a using state, showing an example of the seat belt apparatus.
Figure 8:
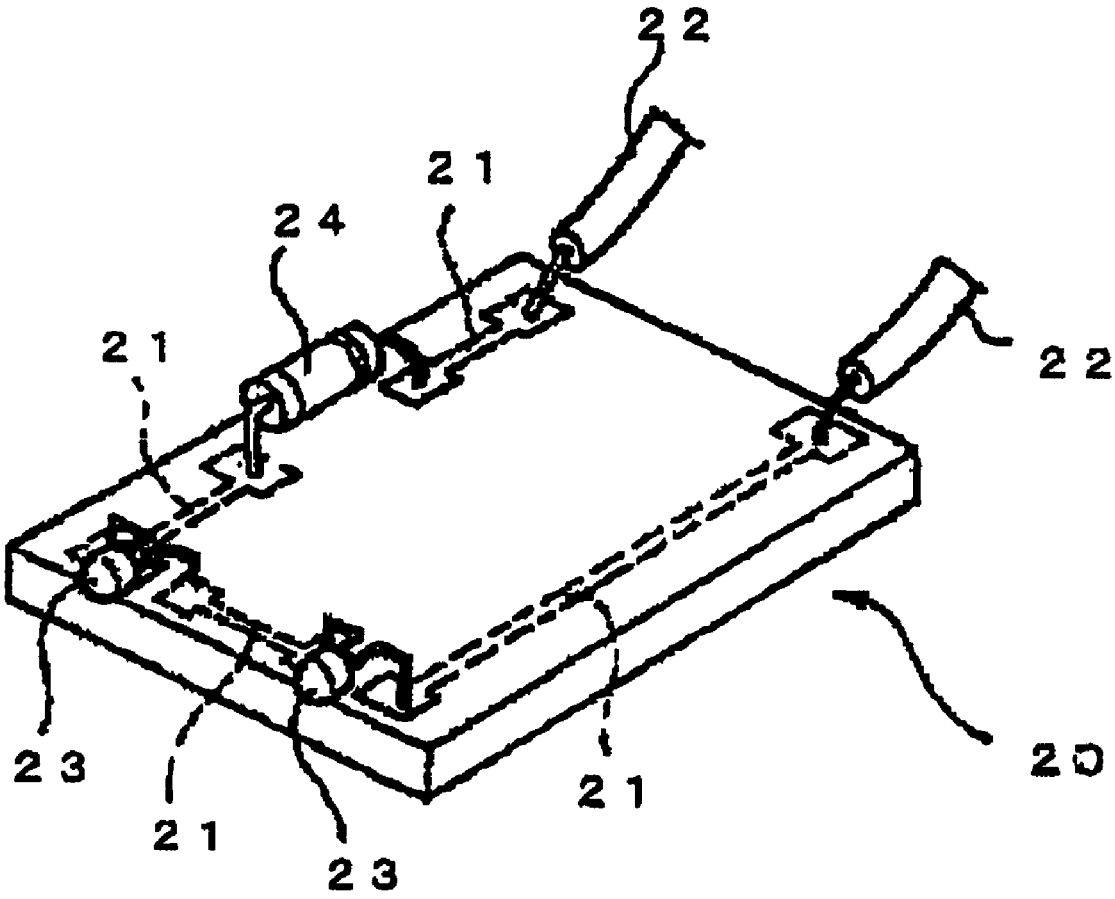
FIG. 8 PRIOR ART
FIG. 8 is a perspective view illustrating an illuminating apparatus that is built in the conventional buckle apparatus.
Figure 9A:
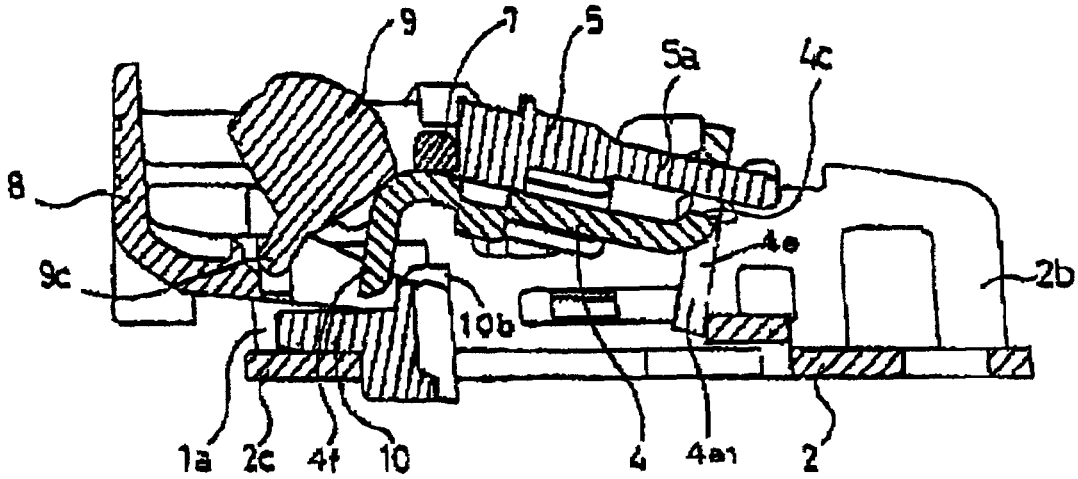
FIG. 9(a) PRIOR ART
FIG. 9(*a*) is a longitudinal cross-section illustrating the conventional buckle apparatus in a non-latched (disengaged) state with a tongue.
Figure 9A:
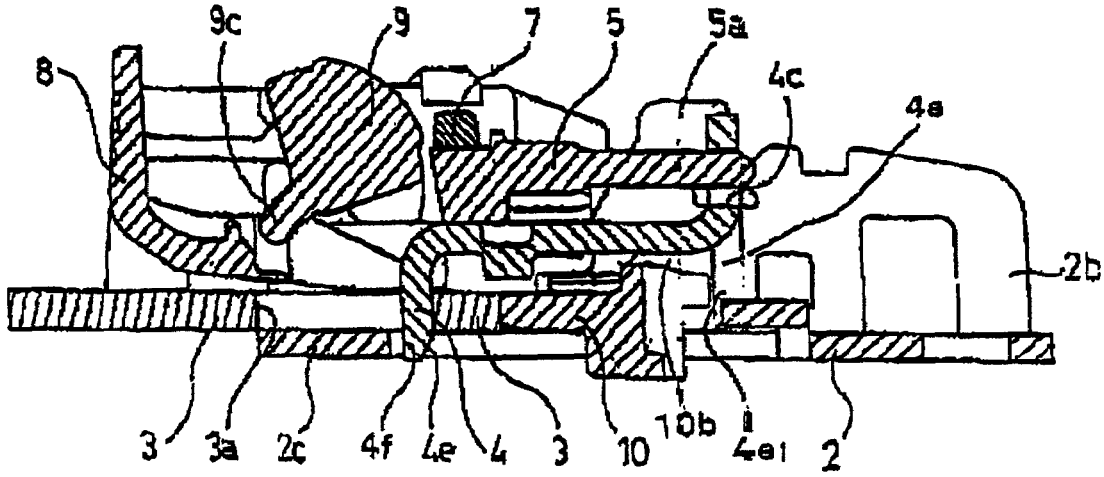
FIG. 9(a) PRIOR ART
Figure 10:
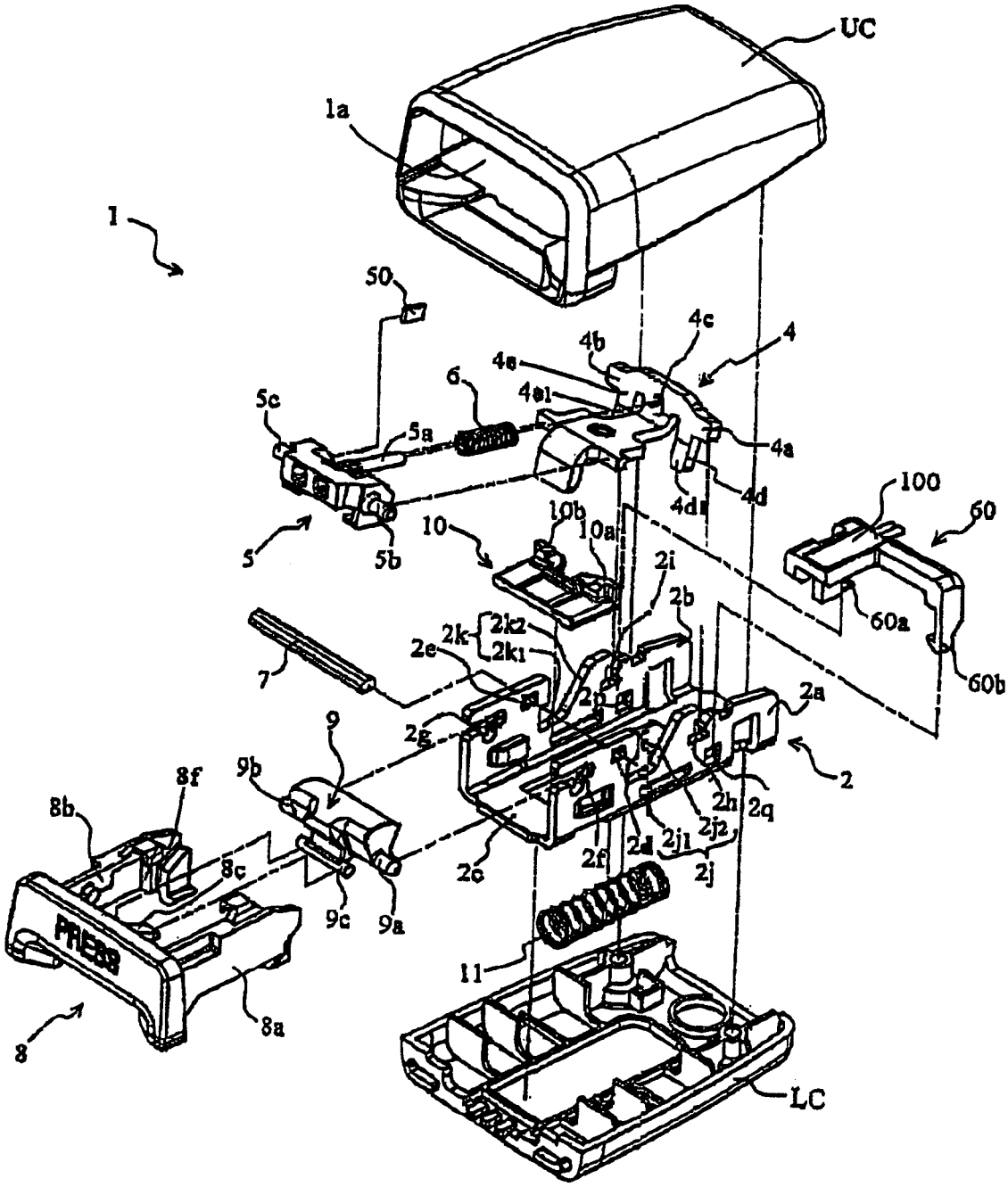
FIG. 10 PRIOR ART
FIG. 10 is an exploded perspective view illustrating an entire structure of the conventional buckle apparatus.

In FIG. 7, a numeral 31 denotes webbing for keeping an occupant under restraint, one end of which is supported by means of an anchor 32 fixed in the vicinity of a floor face of the motor vehicle, and the other end of which is retractably supported by means of a retractor apparatus 33 fixed in the vicinity of the floor face of the motor vehicle; a numeral 34 denotes a shoulder anchor, through which a middle portion of the webbing 31 is inserted, which is rotatably held on a center pillar P of the motor vehicle being situated nearer an upper part thereof, and a numeral 35 denotes a tongue being provided between the anchor 32 and the shoulder anchor 34, being positioned at a side opposite to the anchor 32 across a seat 36, and being engageable with a buckle apparatus 40 connected to a predetermined fixation side member 37.

The buckle apparatus 40 is formed into a predetermined housing shape by means of a combination structure of an upper cover 41 and a lower cover 42, both of which constitute a cover of the buckle apparatus 40, shown in FIG. 1. In addition, a buckle portion 43 to be engaged with the tongue 35, when the tongue 35 is inserted, and an illuminating portion 44 situated nearer an insertion inlet side for the tongue 35 in relation to the buckle portion 43 are provided in an inner part of the buckle apparatus 40.

The buckle 43 is provided with a base 45 that is functionally and substantially identical of the base 2 formed of the U-shaped frame that is explained in Background Art section, and a latch member 46 being rotatably supported at both sides of the base 45 and capable of being latched with the tongue 35. However, a detailed explanation therefore will be omitted here. Further, a shaft 47 to be connected to the fixation side member 37 and an operating member 48 to be used when a releasing operation for locking is performed are provided in the base 45.

The illuminating portion 44 is provided with a pair of LED holding boards 49 which is installed in a standing manner in a vertical (up and down) direction, shown in FIG. 1, a flexible lead wire 50 that electrically connects the pair of LED holding boards 49, a switch board 51 that electrically connects the lead wire 50 and a power source at a motor vehicle side (not shown), a reflector (lens) 52 being fixed to a tip end of the switch board 51, which is situated nearer the tongue insertion inlet side in relation to the LED holding board 49. In addition, although the switch board 51 and the LED holding board 49 are electrically connected by means of a lead wire (not shown) or the like, the switch board 51 may be integrally formed with the LED holding board 49.

The LED holding board 49 is held by the lower cover 42 by mere inserting operation. This is because the LED holding board 49 is inserted into a pair of guide groove walls, 42*a* and 42*a*, formed in the lower cover 42, and the hooking claw 42*b* is hooked with the hooking hole 49*a*. Further, a slimline LED light source 53 facing the reflector 52 is provided in the LED holding board 49, as shown in FIG. 2(*a*).

Further, in at least a part of light receiving face 52A in the reflector 52 facing the slimline LED light source 53, a curved face portion 52*a* being caved in a round shape (concave face) that leads illuminating light flux eradiated from the slimline LED light source 53 to a substantially whole area (substantially an entire face) of a light emitting face 52B is formed. Further, the shape of the concave face (curved face) is determined corresponding to a shape of the slimline LED light source 53 and a shape of the eradiating light thereof, an external shape of an entire reflector 52, and a shape of the light emitting face 52B and that of the light receiving face 52A, and further, a positional relationship between the light emitting face 52B and the light receiving face 52A. In this example, corresponding to the reflector 52, as a whole shape or the like, the shape of the curved face portion 52*a* is that of asymmetry, whichever looking at a horizontal cross-section (refer to FIG. 3(*a*)) or looking at a side cross-section (refer to FIG. 3(*b*)) (in other words, the third dimensional asymmetry).

As described above, in the present embodiment, occurrence of an unevenness of brightness at the light emitting face 52B can be suppressed. This is because incident light from the light source 53 can be led at least to a substantially whole area of the light emitting face 52B exposed to a surface of an insertion inlet 41*a* of the tongue 35 by means of the curved face portion 52*a* provided at the light receiving face 52A of the reflector 52.

FIGS. 4(*a*) through 4(*b*) are illustrations explaining this effect. FIGS. 4(*a*) and 4(*b*) are comparative examples where the curved face is not provided in the aforementioned light receiving face (corresponding to the aforementioned FIGS. 3(*a*) and 3(*b*), respectively). In the reflector 52' of the comparative example, in which a light receiving face 52A' is formed of a usual flat surface, as illustrated in FIGS. 4(*a*) and 4(*b*), the incident light flux from the light receiving face 52A' proceeds to the light emitting face 52B' as a parallel light, for example, and as a result, the light flux does not reach areas a, b, c, and the like in the illustration, and these areas are caused to be relatively dark. Accordingly, the unevenness of the brightness occurs at the light emitting face 52B'.

In contrast, in the reflector 52 of the present embodiment, shown in FIGS. 4(*c*) and 4(*d*), the curved face 52*a* is provided in the light receiving face 52A and thereby the incident light flux from the light receiving face 52A proceeds to the light emitting face 52B while being diffused. Consequently, the light flux evenly reaches the whole area of the light emitting face 52B and the relatively dark part does not exist. Therefore, the unevenness of the brightness at the light emitting face 52B mentioned above can be prevented from occurring.

Further, the light intensity (brightness) of the slimline LED light source 53 can be also controlled corresponding to conditions, such as a size of the insertion inlet 41*a*, a size and a position for the buckle apparatus 40 to be disposed in the motor vehicle, and the like. At this moment, as a method to control the light intensity, in a stage of manufacture, an appropriate light intensity control device 55 is constructed to be detachably (in a replaceable manner) disposed, as shown in FIG. 2(*b*) (connected in series to the light sources, 53 and 53), for example, and it is sufficient to construct such that an optimum light intensity control device is selected while exchanging various light intensity control devices 55 corresponding to the required capability and the specifications therefore. In addition, as a concrete example of the light intensity control device 55, an appropriate resistor or resistance unit can be applicable. Otherwise, a variable resistor may be applied to one light intensity control device 55.

In this case, a more precise brightness setting operation can be performed by means of providing the aforementioned light intensity control device 55, and in addition, a brightness control and a confirmation for the unevenness of the brightness can be simultaneously performed. As a result, there is an effect that the working hours and a manufacturing cost can be decreased.

In addition, as a further variation, in replacement of the above-described slimline LED light source 53, a usual dome-type LED light source 54 may be applicable, as shown in FIGS. 5(*a*) and 5(*b*). Furthermore, the dome-type LED light source 54 can be attached to a transverse LED holding board

49 as shown in FIGS. 6(*a*) and 6(*b*). In these cases, similar effects can be obtained as can be obtained in the above-described embodiments.

What is claimed is:

1. A buckle apparatus for a vehicle, the buckle apparatus comprising:

a cover having a side with an inlet;

a buckle mechanism at least partially covered by the cover and adapted for engaging a tongue of a seat belt inserted through the inlet;

a light source provided in the vicinity of the inlet;

a reflector adjacent the light source;

a light emitting face of the reflector, the light emitting face having a predetermined area from which light from the light source is emitted to illuminate the inlet;

a light receiving face generally facing the light source, the light receiving face being configured to diffuse light from the light source through the reflector so that light reaches the light emitting face across substantially the entire predetermined area thereof; and a light intensity control device for controlling an amount of light emitted from the light source for a desired amount of illumination of the inlet.

2. The buckle apparatus of claim 1, wherein the light receiving face has a portion that has other than a flat configuration.

3. The buckle apparatus of claim 2, wherein the face portion is configured for generally radially diffusing light through the reflector.

4. The buckle apparatus of claim 2, wherein the inlet includes an insertion direction for receiving the tongue, and wherein the face portion is configured for emitting light through the reflector in a plurality of non-parallel directions relative to the insertion direction.

5. The buckle apparatus of claim 2, wherein the light source emits a generally conical beam of light therefrom which is received by the light receiving face portion.

6. The buckle apparatus of claim 2, wherein the light source has a distal end with a domed light emitting surface for radially emitting light toward the face portion of the light receiving face.

7. The buckle apparatus of claim 2, wherein the face portion of the light receiving face of the reflector is concave and arcuate for radially emitting light through the reflector.

8. The buckle apparatus of claim 2, wherein the face portion of the light receiving face of the reflector is positioned a predetermined distance from the light source and configured to receive substantially all of the light emitted from the light source.

9. The buckle apparatus of claim 1, wherein the light receiving face has a portion that has an arcuate configuration.

10. The buckle apparatus of claim 1, wherein the light receiving face has a central, concave portion, and a flat portion extending about the central, concave portion.

11. The buckle apparatus of claim 10, wherein the light source and the light receiving face are configured and positioned relative to each other so that substantially all the light emitted from the light source is received by the central, concave portion of the light receiving face.

12. The apparatus of claim 1, further comprising a plurality of the light sources all connected in series to the intensity control device.

* * * * *

UNITED STATES PATENT AND TRADEMARK OFFICE

CERTIFICATE OF CORRECTION

PATENT NO. : 7,568,265 B2
APPLICATION NO. : 11/420311
DATED : August 4, 2009
INVENTOR(S) : Shigeru Kohama It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 491 days.

Signed and Sealed this

Seventh Day of September, 2010

David J. Kappos

David J. Kappos
*Director of the United States Patent and Trademark Office*